US007345956B2

(12) United States Patent
Matthey

(10) Patent No.: US 7,345,956 B2
(45) Date of Patent: Mar. 18, 2008

(54) PORTABLE ELECTRONIC DEVICE WITH ANALOG DISPLAY RATE OF CLIMB INDICATOR

(75) Inventor: Gérald Maurice Matthey, Ballaigues (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 10/598,549

(22) PCT Filed: Mar. 2, 2005

(86) PCT No.: PCT/EP2005/002166

§ 371 (c)(1),
(2), (4) Date: Sep. 5, 2006

(87) PCT Pub. No.: WO2005/096106

PCT Pub. Date: Oct. 13, 2005

(65) Prior Publication Data

US 2007/0183263 A1 Aug. 9, 2007

(30) Foreign Application Priority Data

Mar. 3, 2004 (EP) ..... 04100861

(51) Int. Cl.
*G04B 47/06* (2006.01)
*G01L 7/20* (2006.01)
*G01L 9/00* (2006.01)

(52) U.S. Cl. ..... 368/11; 73/384; 73/714; 73/753; 702/139; 702/166

(58) Field of Classification Search ..... 368/10, 368/11; 73/384, 714, 753; 702/138, 139, 702/166

See application file for complete search history.

(56) References Cited

U.S. PATENT DOCUMENTS 3,696,610 A * 10/1972 Charbonnier ..... 368/1

(Continued)

FOREIGN PATENT DOCUMENTS

EP 0 308 522 A 3/1989

(Continued)

OTHER PUBLICATIONS

International Search Report issued in corresponding application No. PCT/EP2005/002166 completed Jul. 13, 2005 and mailed Jul. 26, 2005.

(Continued)

*Primary Examiner*—Vit W Miska
(74) *Attorney, Agent, or Firm*—Griffin & Szipl, P.C.

(57) ABSTRACT

A portable electronic device (1) is described, in particular of bracelet watch type, comprising at least first and second display members (8 and 9), means (23, 31) for making measurements of a physical magnitude related to the value of the altitude and a memory zone (26) for storing the measured values of the physical magnitude. The electronic circuits (20) of the device are adapted to control the analog display members, in one mode of operation called the rate of climb mode, so that a first display member (9) indicates the instantaneous rate of change of altitude and the second display member (8) indicates the value of a mean rate of change of altitude against appropriate graduations (10) of the device. Such a device finds its principle application in the field of aeronautical sports.

5 Claims, 2 Drawing Sheets

U.S. PATENT DOCUMENTS

| | | | | |
|---|---|---|---|---|
| 4,257,112 | A | 3/1981 | Hubner | |
| 4,539,843 | A | 9/1985 | Wise | |
| 4,835,716 | A | 5/1989 | Tamaki et al. | |
| 5,251,190 | A * | 10/1993 | Miyasaka et al. | 368/10 |
| 5,500,835 | A | 3/1996 | Born | |
| 6,385,134 | B1 * | 5/2002 | Lange et al. | 368/11 |
| 6,842,402 | B2 * | 1/2005 | Germiquet et al. | 368/10 |

FOREIGN PATENT DOCUMENTS

| | | |
|---|---|---|
| EP | 0 500 386 A1 | 8/1992 |
| EP | 0 581 957 A1 | 2/1994 |
| EP | 0 685 711 A2 | 12/1995 |

OTHER PUBLICATIONS

Form PCT/IPEA/416 International Preliminary Report of Patentability with translation of amended claims and verification of translation.

* cited by examiner

PORTABLE ELECTRONIC DEVICE WITH ANALOG DISPLAY RATE OF CLIMB INDICATOR

This is a National Phase Application in the United States of International Patent Application No. PCT/EP 2005/002166 file Mar. 2, 2005, which claims priority on European Patent Application No. 04100861.6, filed Mar. 3, 2004. The entire disclosures of the above patent applications are hereby incorporated by reference.

TECHNICAL FIELD

The present invention relates to a portable electronic device comprising a case containing a dial and motor means controlling at least two analog display members disposed above the dial. The device according to the present invention comprises in particular means for determining the value of a physical magnitude related to the altitude at a given instant in one particular mode of operation, electronic circuits comprising in particular a time base, means for processing the value and means for storing one or several of the determined or processed values of the physical magnitude.

TECHNOLOGICAL BACKGROUND

Such devices are known in the prior art. In particular, portable electronic devices are known displaying an altimeter function, usually intended to be used when hiking.

However, in order to practise some activities, an indication of the altitude is not sufficient for the wearer of the device. In particular, in the practice of aeronautical sports involving piloting unpowered aircraft, it is important for the pilot to have information relative to his vertical speed of movement. The onboard instruments existing on transport aircraft present a large number of functions which are not all provided for the pilots of light aircraft of glider, microlite, para-glider or delta plane type.

Furthermore, in the practice of some other sports, such as parachute jumping, hiking or even mountain biking, the fact that the sportsman has available information about his altitude is useful and even essential in that which relates to free fall. However, it can be of interest to persons performing this type of activity to have complementary information available.

SUMMARY OF THE INVENTION

A first object of the present invention is to overcome the above-mentioned problems of the prior art by providing a portable electronic device providing its wearer with information relating to his vertical speed of displacement.

Another object of the invention is to provide a portable electronic device whose display is intuitive and enables the user to have rapid and readable access to information representing his situation at a given instant.

To this end, the invention provides in particular a portable electronic device of the type specified above, characterized in that the processing means are adapted to produce first control signals for the motor means, based on determined values of said physical magnitude. The nature of these electrical signals enables a display on the one hand of a rate of change of the instantaneous altitude by a first analog display member and on the other hand of a mean rate of change of altitude over a defined interval of time by a second analog display member.

In the context of the present description it is to be understood that "instantaneous" speed means that the interval separating two successive measurements on the base of which said rate is calculated is relatively short, in particular relative to the duration separating two measurements used to calculate the mean rate. By way of non-limiting example, it can be provided that the instantaneous rate is calculated every one or two seconds if the mean rate is calculated over a minute and that the instantaneous rate is calculated every 15 or 30 seconds if the mean rate is calculated over half an hour.

Because of the arrangement according to the present invention it only needs very little time for the wearer of the device to know his instantaneous vertical speed when he consults the display, while the position of the first analog display member relative to that of the second analog display member additionally gives him a qualitative indication of his situation in terms of acceleration or deceleration.

According to a preferred embodiment of the device, the means for determining the value of the physical magnitude related to the altitude comprise a pressure sensor, whose measurements are transmitted to the processing means, which are arranged to derive from these measurements the value of the vertical speed of progress of the wearer of the device at a given instant.

It can also be provided that the determination of the speed comprises a step of determination of the value of the altitude. Because of this the device according to the invention can be arranged in such a manner that the value of the altitude at a given instant can be displayed, either in a different mode of operation by the same display members or simultaneously with the aid of a supplementary digital display area for example.

BRIEF DESCRIPTION OF THE DRAWINGS

Other features and advantages of the present invention will appear more clearly from a reading of the detailed description which follows, given by way of non-limiting example with reference to the accompanying drawings, in which.

DETAILED DESCRIPTION

Figure 1:
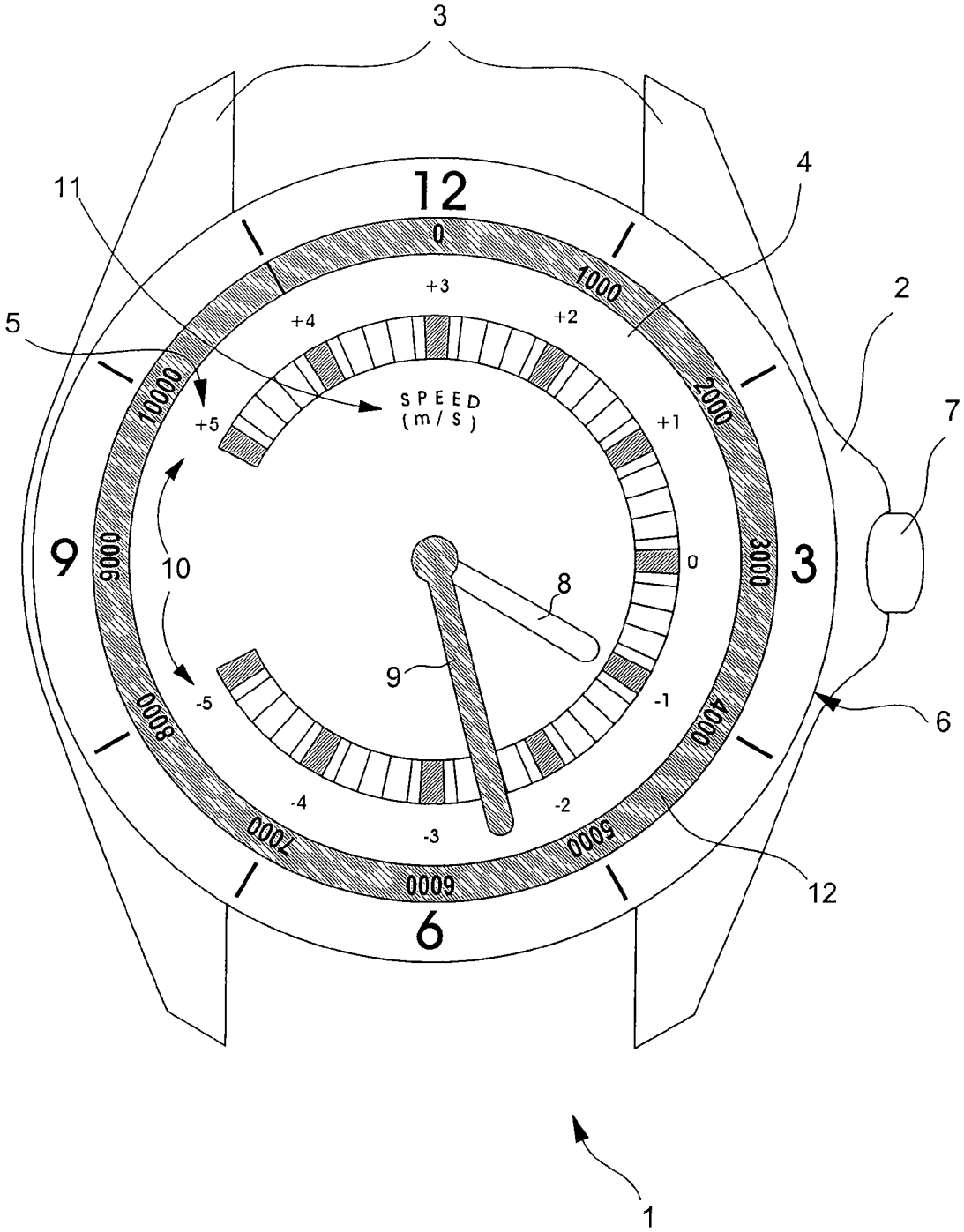
FIG. 1 shows a front view of a portable electronic device according to a preferred embodiment of the present invention.

FIG. 1 represents a first preferred embodiment of the portable electronic device according to the present invention, in the form of a watch especially which is adapted for use with unpowered aircraft and is very simple both from the structural point of view and from the point of view of its operation. The watch 1 has the appearance of a watch of conventional type. Thus it comprises a case 2 which may be for example of case-back type, moulded in plastics material, comprising lugs 3 for attaching a bracelet (not shown) and containing in particular a timepiece movement (not shown) and a dial 4, the case 2 being closed on its upper face by a glass 5 with a bezel 6 fixed round its periphery. The watch 1 further comprises a unique control member 7, namely a stem crown which can be used in particular both as a push button as well as for its conventional rotary use.

The bezel 6 carries the scale denoting the time, numerals being inscribed to show the position of 3, 6, 9 and 12 o'clock more clearly.

The watch 1 also has two hands 8 and 9 for indicating the hours and the minutes respectively.

The dial 4 carries graduations 10 in a circle, their unit being meters per second, serving to indicate the value of a vertical speed of displacement or, in other terms, the rate of change of altitude in the framework of a particular mode of operation called the rate of climb mode. The position corresponding to zero vertical speed is located at 3 o'clock while the graduations extend in a symmetrical manner, on the one hand between the 3 o'clock position and the 10 o'clock position to indicate the value of speed of ascent and on the other hand between the 3 o'clock position and the 8 o'clock position to indicate the value of a speed of descent. In particular, by way of example, the graduations lie substantially between −5 and +5 meters per second.

The dial 4 carries a supplementary indication 11, given here by way of example, namely the expression "speed (m/s)", located at the 12 o'clock position inside the graduations. This supplementary indication 11 thus forms virtually the only visible indication on the watch according to the invention which can suggest to an observer that the watch has supplementary functions compared with a conventional watch.

The watch 1 has special technical means which will be described in short below with reference to FIG. 2, enabling it to provide indications specific to the practice of aeronautical sports. These technical means comprise in particular, according to a preferred embodiment of the present invention, a pressure sensor enabling the pressure of the environment outside the watch to be measured at each instant and the value to be transmitted to the electronic circuits of the device. These techniques have been described in numerous documents of the prior art and will not be dealt with in more detail in what follows.

Means within the electronic circuits described below are further arranged to derive the value of the rate of change of the altitude based on measurements made by the pressure sensor.

Thus, by suitable programming of the electronic circuit of the watch according to the present invention, there is provided a first mode of operation, or time mode, in which the conventional functions are effected by the hour and minute hands. In addition, the stem crown 7 has two stable positions and an unstable position, a first stable position being the position of rest in which the stem crown does not perform any function. In conventional manner, the second stable position is a pulled out position relative to the position of rest, in which the stem crown allows the time indication provided by the two hands 8, 9 to be regulated by rotation. The unstable position is attained by pressing on the stem crown in the direction of the case 2 of the watch, a spring (not shown) being provided for returning it to the position of rest when the pressure is released, in the manner of a pushbutton. Each depression effected on the stem crown 7 enables control of the watch to initiate modification of the current display and to display information whose nature can depend on external parameters of the watch.

In a preferred manner, the rate of climb mode is activated manually by the user of the watch 1, by an action on the stem crown 7 which is detected by the electronic circuits of the device.

Once the rate of climb mode is active, the functions associated with the minute and hour hands 9 and 8 respectively are display of the substantially instantaneous rate of change of altitude and display of a mean rate of change of the altitude over a predetermined interval.

The excellent readability of the electronic device 1 according to the present invention will be noted, since the display is sober and only represents a structure which has been proven for several centuries, namely an analog display system, preferably by hands, although use of rotary discs carrying index marks is feasible. Thus only very little time is needed for the wearer to know what is his instantaneous vertical speed when he consults his watch, the position of the minute hand 9 relative to the hour hand 8 additionally providing a qualitative indication of his situation in terms of acceleration or deceleration. By way of example, the situation shown in FIG. 1 corresponds to an "instantaneous" speed of drop in altitude of the order of 2.5 m/s, while the average rate of drop in altitude over the last minute is of the order of 1 m/s. The wearer of the watch is thus alerted by a rapid glance to the fact that he is experiencing or will experience a relatively large acceleration relative to his average speed over the last elapsed minute.

Supplementary functions are also implemented in the watch 1 and are accessible by biasing the stem crown 7. Supplementary functions relative to the magnitude related to the altitude can optionally be provided. The nature of the available functions and the way in which they are accessed are given by way of non-limiting example.

According to the embodiment described here, means are provided to control the hour and minute hands 8 and 9 in response to depression of the stem crown 7 during the rate of climb mode, in such a manner that they superimpose the display of the value of the altitude against supplementary graduations 12 on the dial or the bezel. Automatic return to the mode of display of the rate of change of altitude is then provided after an interval of time of some seconds. It can also be provided, in an alternative or complementary manner, that the return to the rate of climb mode is obtained by a fresh depression of the stem crown 7.

In a similar manner it can also be provided that these means enable the hour and minute hands 8 and 9 to be controlled in response to a depression of the stem crown 7 starting from the time mode, in such a manner that they additionally display the value of the corresponding altitude.

The implementation of the functions described above is explained with reference to FIG. 2, which shows a schematic diagram of the general structure of the electronic circuit of the portable electronic device according to the present invention.

In general terms, the electronic circuit of the watch comprises in particular an integrated circuit 20 comprising a control circuit 21 adapted to manage the conventional time functions of the watch 1, comprising for this purpose a time divider circuit, the control circuit 21 being connected to an oscillator 22 serving as a time base. Time information is produced by the control circuit 21 from this time base, in particular to effect the functions of the time mode and the functions relating to the rate of climb mode.

The control circuit 21 also receives an input of signals generated by a pressure sensor 23, generating electrical analog signals representing the environmental pressure. These signals pass through an analog to digital converter 24 before being supplied as an input to the control circuit 21 in the form of a digital signal.

The pressure sensor 23 is of conventional type and the man skilled in the art will not have any particular difficulty in selecting one which will be adapted to implement the present invention. The pressure sensor is energised in such a way as to effect periodic measurements during operation in the rate of climb mode.

The integrated circuit 20 also comprises memory zones, in particular a first memory zone 25, preferably of non-volatile type, holding a program enabling the control circuit 21 to perform calculations relating to the rate of climb mode, such as for example the conversion of the pressure measurements into values of altitude, then the calculation of the difference between two successive values of altitude to calculate the rate of change. Selection of a re-programmable non-volatile memory (flash or EPROM for example) allows possible subsequent updating of the calculation program.

The integrated circuit 20 comprises in a preferred manner at least one second memory zone 26, which may be of volatile type, in which the results of the calculations effected by the control circuit 21 are stored periodically. This second memory zone 26 is provided in particular to store the values of altitude relating to a predefined temporal window.

By way of example, the device according to the present invention can be programmed in such a manner that the pressure sensor 23 is controlled to effect one measurement of the pressure of the environment per second. It is also provided that the average rate of change of the altitude is calculated over a time window of one minute. Thus the memory zone 26 is arranged in such a manner that it can store at least 60 successive values calculated by the control circuit 21 on the basis of the measurements made by the pressure sensor. For each measurement of the pressure of the environment transmitted by the analog to digital converter 24 to the control circuit 21, the latter calculates an altitude value corresponding to the measured pressure, by a program of conventional type.

The control circuit 21 also calculates the difference between the last calculated value of altitude and the antepenultimate calculated value, read from the memory zone 26, in order to determine the quasi-instantaneous value of the rate of change of altitude. The control circuit further calculates the value of the mean rate of change of altitude on the basis of the last measured value and the value of altitude calculated 60 seconds earlier. This latter value is then replaced in the memory zone 26 by the last calculated altitude value. Thus, each altitude value stored in the memory zone 26 is updated once every 60 seconds.

At the same time, the control circuit 21 sends suitable signals to a driver circuit 27 of bidirectional motor means, in such a manner that the minute hand 9 displays the "instantaneous" rate of change of altitude against the graduations of the dial. Likewise the control circuit 21 produces signals adapted to the driver circuit 27 of the motor means, for example two bidirectional motors, in such a manner that the hour hand 8 displays the mean rate of change of altitude against the same graduations.

In a preferred manner, the control circuit 21 is arranged in such a manner that, while the number of measurements made since passing into the rate of climb mode is less than 60, the mean rate of change of the altitude is calculated on the basis of the last measurement made and the first measurement stored in the memory zone 26, taking into account the duration separating these two measurements.

In addition, the electronic circuit of the watch comprises conventional means (not shown) for detecting the depressions made by the user on the stem crown 7. This is in position A when at rest and has two extreme positions B and C. The position B is unstable and is obtained by depression by the user and activates a function of the control circuit 21 modifying the mode of operation of the watch, as described above. When the stem crown 7 is forced into the position B from the time mode, the control circuit 21 generates signals for the driver circuit 27 of the motors, in such a manner that the hands 8 and 9 for hours and minutes change to display the value of the corresponding altitude. Likewise, when the stem crown 7 is forced into the position B from the rate of climb mode, the control circuit 21 generates signals for the driver circuit 27 of the motors in such a manner that the hour and minute hands 8 and 9 superimpose the value of the corresponding altitude.

By way of example, it can be provided that the display of altitude is maintained for a duration of the order of 3 seconds before returning to the display corresponding to the rate of climb mode. Obviously, in this case the value of altitude indicated by the hour and minute hands is preferably updated once per second, taking into account the new measurements effected by the pressure sensor.

Obviously, the man skilled in the art is capable of programming the integrated circuit 20 of the watch according to the present invention as he wishes, in order to provide the respective responses adapted to the different possible actions on the stem crown 7.

In addition, conventional means well known to the man skilled in the art are implemented in order to allow correction of the current time indicated by the hands 8 and 9 in the time mode, when the stem crown 7 is pulled out into the stable position C.

A supplementary advantage of the portable electronic device according to the invention appears from its aesthetics. Thus, because of the restraint of its presentation, which is not generally the case with conventional devices providing functions related to the practice of aeronautical or high level sports, the present watch can be worn in any circumstances and thus at all times. Thus its user is not obliged to anticipate occasions for indulging in a sport of this type to wear the watch to the extent that it can be worn at all times without any sacrifice of aesthetics.

Obviously several variants in the mode of implementation which has been described can be provided without departing from the scope of the present invention.

In particular it can be advantageous to provide for a digital display region, such as a liquid crystal screen (LCD)—(reference 30 in FIG. 2), enabling indications complementing those provided by the hour and minute hands 8 and 9. Thus, by way of example, such a digital display region can be used advantageously to display the current time during operation in the rate of climb mode. Furthermore the electronic circuits of the device can be so programmed that the digital display region indicates the value of the current altitude at a given instant in response to a suitable action on the stem crown 7, in a manner alternative to or supplementing the use of the graduations 12.

On the other hand, the means used to determine the values of the rate of change of altitude can for example be implemented in the form of a GPS (Global Positioning System) receiver (reference 31 in FIG. 2), which provides an altitude value directly to the control circuit 21 in place of a pressure value as described above. The man skilled in the art will not encounter any particular difficulty in adapting the programming of the electronic circuits of the electronic device as a function of the means employed for determining the rate of change of the altitude.

In a similar manner, the man skilled in the art can provide variants in that which concerns the method of calculating described above for determining the rate of change of altitude, without departing from the scope of the present invention. By way of example, when the means used to determine the value of the altitude comprise a pressure sensor, the electronic circuits of the device can be programmed in such a fashion as to store directly the values of pressure instead of the values of altitude. In this case the control circuit is preferably programmed to calculate a rate of change of the pressure and to convert the result thus obtained into a value of the rate of change of the altitude, before displaying the latter.

Furthermore, the examples of numerical values provided for the ranges of rate of change of altitude to be displayed, as well as the frequency of measurements or the calculations are non-limiting. The manufacturer of such portable electronic devices can in fact provide several different models, each of which is adapted to a defined category of sport, each category covering sports in a group with ranges of rate of change of altitude of the same order of magnitude. By way of example, in addition to the model which has been described and is suitable in particular for gliding, a first supplementary model can be provided, intended for use when performing free fall, for which the mean rate is calculated over a duration of the order of 30 seconds to one minute and the range extends between −100 and +100 m/s, and a second supplementary model for hiking and mountain biking, for which the mean rate is calculated over a duration of the order of half an hour with a range extending between −5000 and +5000 meters per hour.

In an alternative manner, a logarithmic or semi-logarithmic scale can be used to convert a large range of values while retaining good readability for the low values, or even several scales adapted to different ranges of values of the rate can be used. On the other hand, the invention is not limited to a device indicating the sense of change of altitude, as it is the case in the watch shown by way of example. Thus a simple scale indicating the absolute value of the rate of change of altitude can be provided to the extent that, as in the majority of situations, the wearer of the device is normally capable of determining himself the direction of his movement. Such a modified embodiment has the advantage of a scale for indicating the values of the rate which is more extended than that shown in FIG. 1, which allows display of the values of the rate contained in a larger range of values.

Furthermore a model can be provided comprising rate graduations in feet per minute, intended more particularly for users in English-speaking countries.

Equally, the man skilled in the art will be able to modify or omit the graduations 12 relating to the indication of the value of an altitude, without departing from the scope of the present invention.

Figure 2:
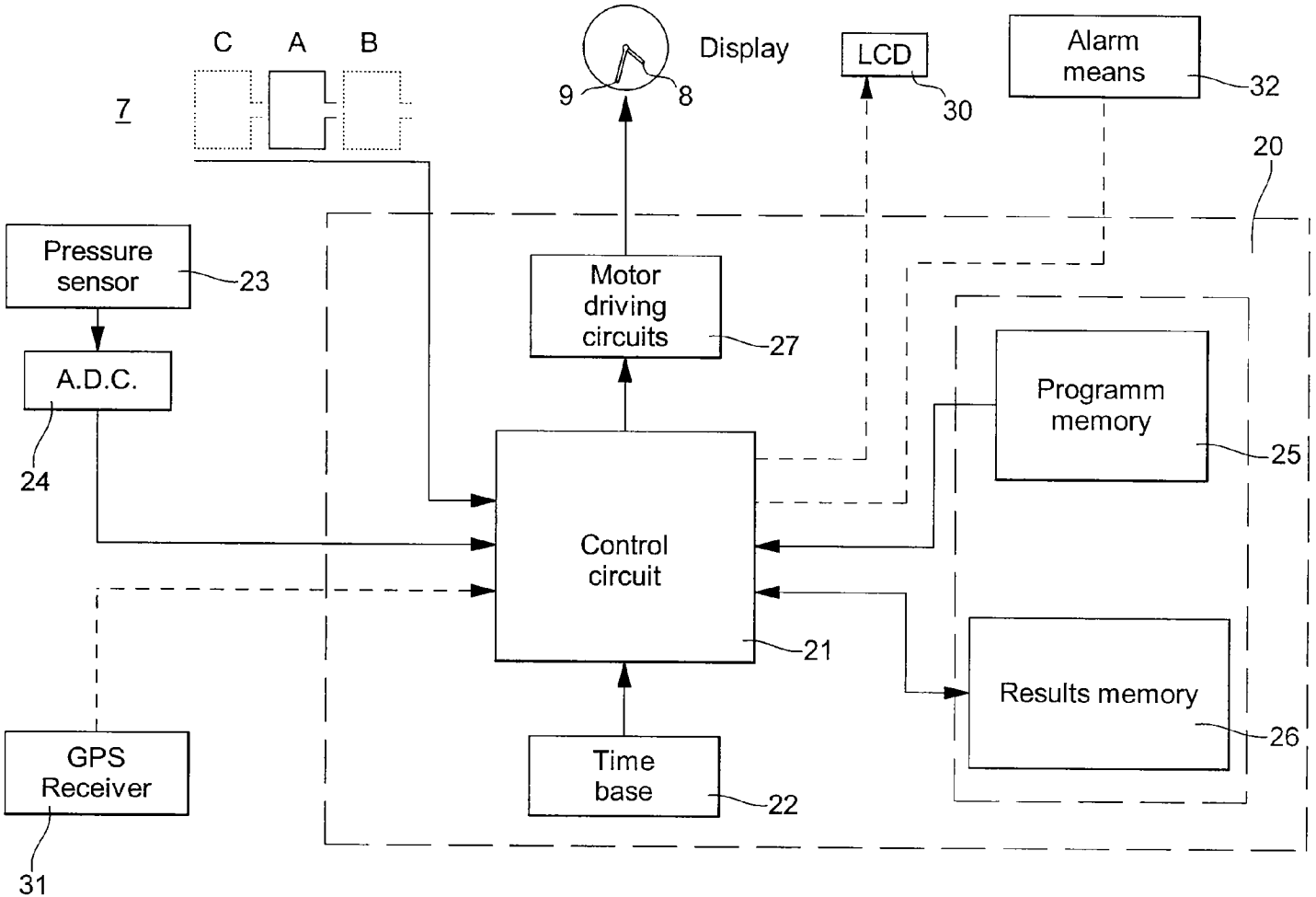
FIG. 2 shows a general block diagram of the electronic circuit of the indicator device shown in FIG. 1.

Variants of embodiments of the electronic device according to the present invention can also be provided in which the device further comprises alarm means (reference 32, FIG. 2). In this case the alarm means are preferably controlled by the electronic circuits 20 in response to detection of overstepping a predetermined value of rate of change of altitude, in order to improve the safety of the wearer. The alarm means 32 can be implemented in the form of a visual or luminous in the region of the bezel of the device, in the form of an audible alarm or even in the form of a vibrator, all of conventional type.

The invention claimed is:

1. A portable electronic device comprising:

(a) a case containing a dial;

(b) at least two analog display members, namely, first and second analog display members, disposed above the dial;

(c) motor means controlling at least two analog display members disposed above the dial;

(d) means for determining value of physical magnitude related to altitude at a given instant;

(e) electronic circuits comprising i. a time base;

ii. means for processing value of physical magnitude related to altitude at a given instant; and iii. means for storing one or several of determined or processed values of physical magnitude, wherein the processing means are arranged to produce first control signals for said motor means based on the determined values of physical magnitude, for effecting, in a rate of climb mode, a display representing an instantaneous rate of change of altitude by the first analog display member and a mean rate of change of altitude over a predetermined interval of time by the second analog display member, wherein position of the first analog display member relative to the second analog display member provides a qualitative indication in terms of acceleration or deceleration; wherein the electronic circuits further comprise iv. a timepiece movement, and wherein the electronic device has a time mode of operation in which the electronic circuits are arranged to produce second electrical signals for the motor means to contact the first analog display member and the second analog display member in such a manner that the first analog display member and the second analog display member display current time.

2. The device according to claim 1, wherein said means for determining the value of physical magnitude related to altitude comprises a pressure sensor.

3. The device according to claim 2, wherein said electronic circuits are further arranged to determine the value of altitude at a given instant on the basis of the value determined by said means for determining.

4. The device according to claim 1, said device further comprising (f) a digital display area, wherein said electronic circuits are further arranged to determine the value of altitude at a given instant on the basis of the value determined by said means for determining and to produce third electrical signals for a control circuit for said digital display area to display said determined value of altitude.

5. The device according to claim 1, wherein said processing means comprises processing circuits arranged to produce supplementary electrical signals for alarm means in response to detection of overstepping a predetermined value by one of said determined values of said physical magnitude.

* * * * *